US006512911B2

(12) United States Patent
Arai et al.

(10) Patent No.: US 6,512,911 B2
(45) Date of Patent: Jan. 28, 2003

(54) TONER CARRIER HAVING A PARTICULAR Z VALUE, A PARTICULAR CREEP VALUE, OR A PARTICULAR UNIVERSAL HARDNESS

(75) Inventors: Toshiaki Arai, Tokyo (JP); Koji Takagi, Kanagawa (JP); Kazuya Murata, Tokyo (JP); Takao Ohuchi, Tokyo (JP); Norio Nihei, Tokyo (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/916,589

(22) Filed: Jul. 30, 2001

(65) Prior Publication Data

US 2002/0031378 A1 Mar. 14, 2002

(30) Foreign Application Priority Data

Jul. 28, 2000 (JP) ..... 2000-228658
Jul. 28, 2000 (JP) ..... 2000-228659
Mar. 30, 2001 (JP) ..... 2001-100133

(51) Int. Cl.[7] ..... G03G 15/08
(52) U.S. Cl. ..... 399/286; 492/56
(58) Field of Search ..... 399/286, 279; 492/53, 56

(56) References Cited

U.S. PATENT DOCUMENTS 4,967,231 A * 10/1990 Hosoya et al. ..... 361/221
5,084,735 A 1/1992 Rimai et al. ..... 355/271
5,241,343 A * 8/1993 Nishio ..... 399/176
5,732,314 A 3/1998 Tsukida et al. ..... 399/302
5,978,639 A 11/1999 Masuda et al. ..... 399/302
6,175,712 B1 * 1/2001 Masuda et al. ..... 399/302

FOREIGN PATENT DOCUMENTS

JP 2000-047495 2/2000
JP 2000-047496 2/2000

* cited by examiner

*Primary Examiner*—Joan Pendegrass
(74) *Attorney, Agent, or Firm*—Oblon, Spivak, McClelland, Maier & Neusttadt, P.C.

(57) ABSTRACT

There are disclosed a toner carrier (I) having at least 0.70 of Z value, which is obtained from the formula (1) and deformation restoration behavior of the surface of the toner carrier at the time of measuring the universal hardness of the surface thereof:

$$Z=We/(We+Wr) \quad (1)$$

wherein We is elastic energy and Wr is plastic energy; a toner carrier (II) having at most 10.0 $\mu$m of 60 sec. creep value obtained from deformation restoration behavior of the surface of the toner carrier under measuring condition at a definite load of 100 mN /mm$^2$; and a toner carrier (III) having at most 3 N /mm$^2$ of universal hardness at a depth of at most 5 $\mu$m from the surface of the toner carrier under measuring condition at a definite load applying rate of 100/60(mN/mm$^2$/sec.). Each of the toner carriers can afford steadily favorable images.

20 Claims, 1 Drawing Sheet

TONER CARRIER HAVING A PARTICULAR Z VALUE, A PARTICULAR CREEP VALUE, OR A PARTICULAR UNIVERSAL HARDNESS

BACKGROUND OF THE INVENTION

1. Field of The Invention

The present invention relates to a toner carrier and an image formation apparatus using the same. More particularly, the present invention is concerned with a toner carrier which is intended to form a visible image on the surface of an image formation body by supplying a toner to the image formation body such as a photosensitive body, paper or the like that preserves an electrostatic latent image in an image formation apparatus such as copying machinery, printers or the like, and which affords a high quality image free from image unevenness, is also minimized in variation of its characteristics during a long-term service, and is excellent in durability. The present invention also relates to an image formation apparatus using the same.

2. Description of the Related Arts

In regard to an electrophotographic image formation method including copying machinery, printers or the like, there is previously known a pressurized developing method as an image formation method which comprises supplying a unary toner to an image formation body such as a photosensitive body preserving an electrostatic latent image, and visualizing the latent image by allowing the toner to adhere to the latent image (refer to U.S. Pat. Nos. 3,152,012 and 3,731,146).

The pressurized developing method, which performs the image formation by bringing a toner carrier that supports a toner into contact with an image formation body such as a photosensitive body preserving an electrostatic latent image, and allowing the toner to adhere to the latent image on the aforesaid image formation body, thus requires the above-mentioned toner carrier to be constituted of an electroconductive elastic body having both electroconductivity and elasticity.

Specifically in the foregoing pressurized developing method the constitution is such that, for instance, as illustrated in FIG. 2, a toner carrier 1 (developing roller) is placed between a toner application roller 5 for supplying a toner and an image formation body 6 (photosensitive body, etc.) preserving an electrostatic latent image; the toner carrier 1 (developing roller), the image formation body 6 (photosensitive body, etc.) and the toner application roller 5 rotate each in the direction of the arrow in FIG. 2, thereby a toner 7 is supplied onto the surface of the toner carrier 1 (developing roller) with the toner application roller 5; the toner carrier 1 (developing roller) rotates, while being in contact with the image formation body 6 (photosensitive body, etc.) in a state that the toner is arranged into a uniform thin film by a layer forming blade 8; and the toner thus formed into a thin film is allowed to adhere to a latent image on the image formation body 6 (photosensitive body, etc.) from the toner carrier 1 (developing roller), whereby the aforesaid latent image is visualized.

In such image formation apparatus by means of pressurized developing system as the above, the toner carrier 1 is obliged to rotate, while maintaining the state of close contact with the image formation body 6. For this reason, the constitution of the toner carrier 1 is such that as illustrated on the schematic cross section of the attached FIG. 1, a shaft 6 consisting of an electroconductive material such as a metal is equipped on its outside periphery with an electroconductive elastic layer 3 composed of an electroconductive elastic body which is imparted with electroconductivity by blending an electroconductivity imparting agent in elastic rubber such as silicone rubber, acrylonitrile butadien rubber, ethylene propylene rubber and polyurethane rubber or foam thereof. In addition, a coating layer 4 composed of a resin or the like is installed on the surface of the electroconductive elastic layer 3 for the purpose of controlling electrostatic property and adhesivity for the toner, controlling force of friction between the image formation body and the layer forming blade, or preventing fouling of the image formation body due to the elastic body.

On the other hand, a proposal is made on an image formation method for forming an image by allowing a toner supported on a toner carrier to directly jump over onto an image formation body composed of paper sheets such as paper, OHP paper sheet or the like via a perforated controlling electrode.

Another proposal is also made on a method for forming an image by supporting a non-magnetic toner layered into thin layer on the surface of a toner carrier which is in the form of sleeve and which is placed in a non-contact state in the vicinity of a photosensitive body, and allowing the toner to jump over onto the photosensitive body to form images {refer to Japanese Patent Application Laid Open No. 116559/1983 (Showa 58)}.

In both the above-mentioned methods, the electroconductive elastic layer for a toner carrier is equipped on the surface thereof with a coating layer composed of a resin or the like for the purpose of controlling electrostatic property and adhesivity for the toner, or decreasing force of friction with an other member such as the photosensitive body, layer forming blade, controlling electrode and the like.

It has been suggested by the present inventors that the friction and image characteristics can be improved by a toner carrier wherein such a resin as melamine resin, phenolic resin, alkyd resin, fluororesin and polyamide resin is employed in a coating layer.

However, accompanying the major currents in recent years towards high speed of a printer, improvement required of image fineness, colored image and the like, the requirements for image forming properties have come to be increasingly strict, thus actualizing a variety of problems with which conventional toner carriers can no longer cope. In particular, the problems still remain unsolved in that (a) an increase in toner damage caused by high speed tendency is grasped as an important problem which leads to defective image such as fog due to poor electrification of a toner upon long-term service of a toner carrier, and (b) while the demand for evenness in image quality is increasingly accentuated, there take place such defective images as fogging of white image, unevenness in half tone image and unevenness in density of black image accompanying increase in the number of printing sheets in the case of long-term service of a toner carrier by incorporating it in an image formation apparatus.

With respect to the durability of the toner carrier, there are caused as the case may be, the problems in that agglomerated toner which brings about filming or fusedly fixing attributable to toner damage scrapes off and wears the toner carrier or a member in contact therewith, thereby inducing toner leakage.

Appropriate elimination of damaged toner is the drastic measure of solving against various problems attributable to toner damage, but it is difficult with the state of the art to completely remove damaged toner from a developing system. In this case, as the countermeasure from the side of the toner carrier it is one of effective means for suppressing toner damage to decrease the hardness of the toner carrier so as to absorb as much as possible the pressure of contact with other members. On the other hand, however, it is known that in the case of the toner carrier being flexible and markedly low in hardness, when such carrier is incorporated in a printer or the like and is used for imaging after a long-term non-use state, deformation remains which is due to press contact between the carrier and a layer forming blade in half tone image, sometimes causing streaky trace (defective set image). On the basis of the knowledge, it is taken into consideration to adopt a method for enhancing wear resistance of the toner carrier by increasing the hardness thereof to the utmost, while limiting the the quantity of deformation due to press contact therebetween. Nevertheless in such a case, the stress applied to a toner is extremely increased, thus giving rise to an increase in damaged toner. As a result, variation in the electrification characteristics of the toner takes place, whereby a markedly adverse influence upon the image characteristics is almost impossible to prevent.

Moreover, it is the drastic measure of solving against toner leakage due to the wear of the toner carrier to prevent filming or fusedly fixing of the toner. However, owing to the design trend towards shifting the glass transition temperature of a toner to the lower side from the preference for energy saving in recent years, the solution of the present subject is increasingly made difficult. In such circumstances it is thought that importance should be attached to such design concept as excluding to the utmost, the factors for causing agglomerated toner as the countermeasure from the side of the toner carrier.

SUMMARY OF THE INVENTION

The present invention has been made in such circumstances. That is to say, a general object of the present invention is to provide a toner carrier which is capable of suppressing toner damage, preventing another evilness caused by suppression of toner damage such as defective image, and affording steadily favorable image even in a working environment more prone to cause defective image including long-term preservation and long-term service; and to provide an image formation apparatus in which use is made of the above-mentioned toner carrier.

Another object of the present invention is to provide a toner carrier which is capable of suppressing a toner carrier from being scraped off by agglomerated toner attributable to toner damage, preventing the generation of a defect such as toner leakage, and affording steadily favorable image even in a working environment more apt to cause defective image including long-term preservation and long-term service; and to provide an image formation apparatus in which use is made of the above-mentioned toner carrier.

Still another object of the present invention is to provide a toner carrier which is capable of affording further high quality image, and which is excellent in durability without causing fogging of white image, roughness in half tone image or unevenness in density of black image even during long-term service; and to provide an image formation apparatus in which use is made of the above-mentioned toner carrier.

Further objects of the present invention will be obvious from the content of the specification hereinafter disclosed.

In such circumstances, intensive research and development were accumulated by the present inventors in order to solve the aforesaid problems. As a result, it has been found that toner damage is suppressed, another evilness caused by suppression thereof is prevented and at the same time, steadily favorable image is obtainable even in a working environment more prone to cause defective image including long-term preservation and long-term service by regulating the physical properties of the surface of the toner carrier so that the "Z-value" as mentioned hereinafter is made to be in the under-mentioned range, said value being obtained from the measurement of deformation restoration behavior of the surface of the toner carrier at the time of measuring the universal hardness.

Specifically, the universal hardness is obtained by the procedure comprising pushing a penetrator in the form of a quadrangular pyramid or a triangular pyramid in the surface of an object to be measured under a prescribed test load applied thereto, finding the surface area of contact between the penetrator and the object to be measured from the pushed-in depth of the penetrator, and finding the hardness from the surface area and the test load. In this case it is also possible to calculate the values of elastic energy and plastic energy among the energies in relation to the deformation of the surface of the object to be measured and also the ratio of each of the energies by pushing any of the above-mentioned penetrator in the object to be measured, and thereafter gradually decreasing the test load applied by the penetrator. In the present invention, it has been found that defective set image can be prevented by regulating the relation between the elastic energy value and the plastic energy value to a specific range. The point to which special attention should be paid is that the viscoelastic characteristics in the vicinity of the surface of the toner carrier contributes to set resistance and also wear resistance of the toner carrier, more than the hardness as measured by Asker C hardness for the whole toner carrier. In the present invention it has also been found that, as the result of investigation on numerical evaluation of the viscoelastic characteristics in the vicinity of the surface of the toner carrier, the viscoelastic characteristics can be evaluated by the "Z-value" as mentioned hereinafter. The present invention has been accomplished by the foregoing findings and information.

It has also been found that the wear of the toner carrier is caused by the agglomerated toner which penetrates in the portion where the toner carrier and sealant of a toner cartridge are in press contact with each other, and accelerates scraping throughout the action of the toner carrier. It is thought that deformation takes place at the portion of press contact during the toner carrier stands still, and immediately after the start of action thereof slight clearance due to residual deformation is generated between the sealant, thereby causing toner to penetrate therein and generating agglomerated toner owing to press contact and friction. It has been presumed from the foregoing by the present inventors that in the case where the toner carrier assumes plastic deformation behavior over a reference value, the probability that the slight clearance is generated is increased, thereby promoting the penetration of the agglomerated toner into the portion of press contact.

Moreover, intensive research and investigation were set forward by the present inventors in the light of the aforesaid attention. As a result it has been found that penetration of the agglomerated toner between the toner carrier and a sealant is suppressed, wear of the toner carrier and the accompanying toner leakage is prevented and at the same time, steadily favorable image is obtainable even in a working environment more prone to cause defective image including long-term preservation and long-term service by regulating the physical properties of the surface of the toner carrier so that the "specific creep-value" is made to be in the undermentioned range, said value being obtained from the measurement of deformation restoration behavior of the surface of the toner carrier at the time of measuring the universal hardness under a measuring condition at a definite load with respect to the toner carrier having an elastic layer and a coating layer composed of single layer or a plurality of layers, said layer/s being formed outside the above-mentioned elastic layer directly or through another layer.

In the case of obtaining the universal hardness in the same manner as the foregoing, by pushing a penetrator in the object to be measured under a measuring condition at a definite load, then preserving the definite load environment, and thereafter gradually decreasing the test load applied by the penetrator, it is made possible to obtain the difference in the position of the penetrator which difference is caused by the plastic deformation of the object to be measured between the initial measurement stage and the time of ending the measurement. The difference therebetween is referred to as for instance, "60 sec. creep value under measuring condition at a definite load of 100 mN/mm$^2$" in the case of the definite load being 100 mN/mm$^2$ and the preservation time at a definite load (creep time) being 60 sec. It has been found that the creep value is caused by the plastic deformation of the toner carrier due to the above-mentioned measurement of deformation restoration behavior, and that the degree of penetration of the agglomerated toner between the toner carrier and a sealant and the degree of accompanying wear of the toner carrier can be standardized, for instance, by the equivalent value obtained by measuring universal hardness by the use of, for instance, a hardness measuring instrument available on the market such as a ultracompact hardness tester ( manufactured by Fischer Corporation under the trade name H-100V). The present invention has been accomplished by the above mentioned findings and information.

In addition, intensive research and investigation were set forward by the present inventors on the problem that in the case where a toner carrier is incorporated in an image formation apparatus and is used for a long period of time, while being accompanied by an increase in the number of printed sheets, there are caused fogging of white image, roughness in half tone image or unevenness in density of black image. As the results, the following three items have been confirmed.

(1) In order to obtain steadily high quality images for a long period of time, it is indispensable that toner properties remain unchanged even under the condition of long-term running.

(2) A toner undergoes stress due to agitation at all times in a developer tank, in particular undergoes maximum stress at portions between the toner carrier and a layer regulating blade and between the toner carrier and a toner supply member, and in the case of long-term running, deterioration of the toner is promoted at the portions mentioned above.

(3) Strong stress, when imposed on a toner, causes deformation and cracking of toner particles, peeling of an external additive and the like, whereby prescribed charge quantity is no longer assured. Consequently overall charge distribution becomes non-uniform, thus bringing about such defective image as fogging of white image, roughness of half tone image and unevenness in density of black image.

In particular, it has been elucidated during the course of the research by the present inventors that the deterioration of the toner is markedly promoted when the toner carrier has a high hardness in close vicinity to the surface thereof.

In the meanwhile, the hardness of a toner carrier has heretofore been usually evaluated by the extent of deformation when a relatively large definite load of approximately one kg is applied thereto as typified by Asker C and JIS A.

According to the research by the present inventors, however it has been elucidated that a toner moving on a toner carrier causes only slight deformation, and the strength of the stress imposed on the toner is not due to a conventional hardness such as Asker C hardness, but is greatly influenced by the hardness upon slight deformation on the surface of the toner carrier or in close vicinity to the surface thereof. Moreover, universal hardness is suitable as an index which denotes the hardness in close vicinity to the surface of the toner carrier, and it is made possible to effectively prevent the deterioration of the toner by limiting the value of the universal hardness within a definite range. As a result, such limitation led to success in assuring steadily high quality image for a long period of time. Thus the present invention has been accomplished through the circumstances as described hereinbefore.

That is to say, the present invention provides:

A toner carrier (I) which supports a toner on its surface to form thin films thereof and in this state, supplies the toner to the surface of an image formation body in contact with or in close vicinity to said image formation body so as to form visible image thereon, said toner carrier having at least 0.70 of Z value, which is represented by the formula (1) obtained from deformation restoration behavior of the surface of said toner carrier at the time of measuring the universal hardness of the surface thereof:

$$Z=We/(We+Wr) \quad (1)$$

wherein We is elastic energy from among the energies in relation to the deformation of the surface thereof, said elastic energy being obtained from deformation restoration behavior of the surface of said toner carrier at the time of measuring the universal hardness of the surface thereof; and Wr is plastic energy therefrom;

An image formation apparatus comprising, as a minimum requirement, a toner carrier and an image formation body on the surface of which is formed a visible image by means of a toner supplied from the toner carrier and which is in contact with or in close vicinity to the toner carrier forming a toner thin film on the surface thereof, said image formation apparatus being equipped with said toner carrier (I);

A toner carrier (II) which supports a toner on its surface to form thin films thereof and in this state, supplies the toner to the surface of an image formation body in contact with or in close vicinity to the image formation body so as to form visible image thereon, said toner carrier having at most 10.0 $\mu$m of 60 sec. creep value obtained from deformation restoration behavior of the surface of said toner carrier under measuring condition at a definite load of 100 mN/mm$^2$ at the time of measuring the universal hardness of the surface thereof;

An image formation apparatus comprising, as a minimum requirement, a toner carrier and an image formation body on the surface of which is formed a visible image by means of a toner supplied from the toner carrier and which is in contact with or in close vicinity to the toner carrier forming a toner thin film on the surface thereof, said image formation apparatus being equipped with said toner carrier (II);

A toner carrier (III) which supports a toner on its surface to form thin films thereof and in this state, supplies the toner to the surface of an image formation body in contact with or in close vicinity to the image formation body so as to form visible image thereon, said toner carrier having at most 3 N /mm$^2$ of universal hardness at a depth of at most 5 $\mu$m from the surface of said toner carrier under measuring condition at a definite load applying rate of 100/60 ($mN/mm^2$/sec.) at the time of measuring the universal hardness of the surface thereof; and An image formation apparatus comprising, as a minimum requirement, a toner carrier and an image formation body on the surface of which is formed a visible image by means of a toner supplied from the toner carrier and which is in contact with or in close vicinity to the toner carrier forming a toner thin film on the surface thereof, said image formation apparatus being equipped with the toner carrier (III).

DETAILED DESCRIPTION OF THE INVENTION

Figure 1:
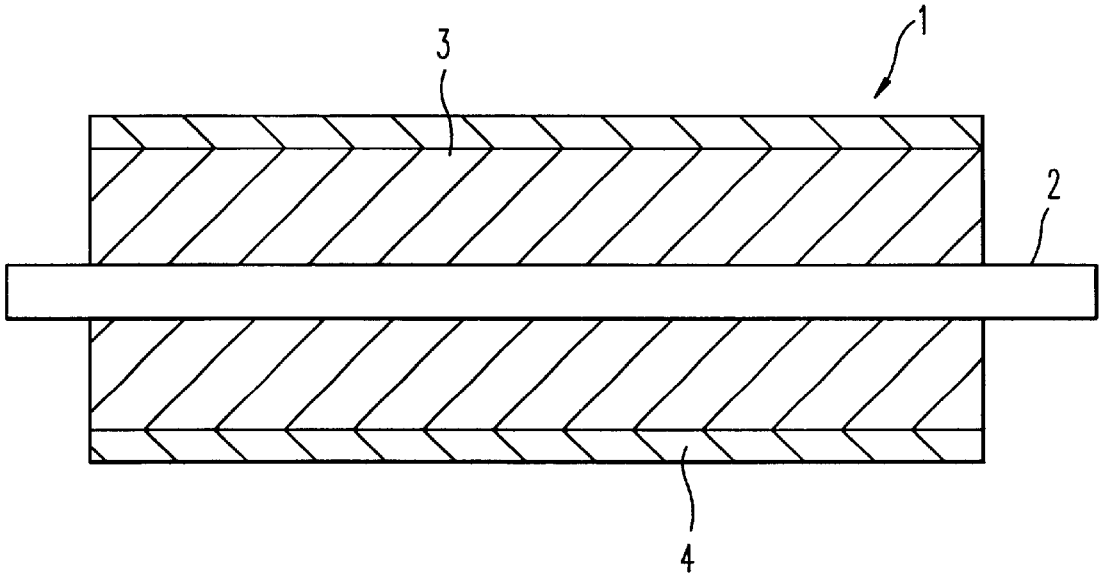
FIG. 1 is a schematic cross-sectional view of an example of the toner carrier according to the present invention.

In the following, the present invention will be described in more detail.

A major characteristic of the present invention resides in that by properly regulating the relation between elastic energy and plastic energy which relation is obtained at the time of measuring the universal hardness of the surface of the toner carrier as described before, it has been realized to prevent the defective set image during long-term preservation, while suppressing the plastic deformation of the toner carrier.

Another major characteristic of the present invention resides in that by optimizing the 60 sec. creep value obtained under measuring condition at a definite load of 100 $mN/mM^2$ at the time of measuring the universal hardness of the surface of the toner carrier as described before, it has been realized to prevent agglomerated toner from penetrating between the toner carrier and a sealant and also prevent toner leakage, while suppressing the plastic deformation of the toner carrier.

Still another major characteristic of the present invention resides in that by optimizing the universal hardness at a depth of at most 5 $\mu$m from the surface of said toner carrier under measuring condition at a definite load applying rate of 100/60 ($mN/mm^2$ /sec.) at the time of measuring the universal hardness of the surface thereof, it has been made possible to assure steadily high quality image for a long period of time, while preventing the deterioration of the toner.

The above-mentioned universal hardness is a physical property value which is obtained by pushing a penetrator in an object of measurement under a test load, and is determined by (test load)/(surface area of the penetrator under the test load) in a unit of $N/mm^2$.

The universal hardness can be measured by the use of a hardness measuring instrument available on the market such as a ultracompact hardness tester(manufactured by Fischer Corporation under the trade name H-100V). In the above hardness measuring instrument, a penetrator in the form of a quadrangular pyramid or triangular pyramid is pushed in an object to be measured under a prescribed test load applied thereto, the surface area wherein the penetrator and the object are in contact with each other is found at the point of time when a desired pushed-in depth has been achieved, and thus the universal hardness is calculated by the foregoing formula.

In the case of measuring said universal hardness, it is made possible to find the values of elastic energy and plastic energy from among the energies in relation to the deformation on the surface of the object to be measured and the ratio of each of the energies by pushing a penetrator in said object, while applying a gradually increasing load thereto up to a prescribed load, and thereafter decreasing the load of the penetrator. Assuming that the object to be measured is a perfect elastic body, when a penetrator is pushed in said object to be measured by increasing the load, followed by the removal of the load by decreasing the same, then the surface of said object is restored to the original state, and the penetrator is returned to the original position, that is, a pushed-in depth of zero. On the contrary, if the object to be measured is a perfect plastic body, even when a penetrator is pushed in said object to be measured, followed by the removal of the load, the surface of said object remains non-restored, and the penetrator is not returned to the original position. By taking advantage of the aforesaid phenomenon, the ratio of elastic energy to plastic energy for said object can be determined. In addition, the same measurement as the foregoing can be conducted under a constant push in load. This method is particularly preferably applicable to the measurement in the present invention, since it enables to obtain the deformation energy behavior in a state close to the environment wherein a trace of press contact is caused between the toner carrier and a layer forming blade. Both the methods enable to measure deformation energy behavior in an extremely shallow region of the surface which has been impossible to measure by a conventional compression set test.

The toner carrier (I) according to the present invention is subjected to surface modification so that the Z value showing the relation between the elastic energy and plastic energy comes to be at least 0.70, preferably in the range of 0.75 to 1.00. In this case, it is possible by means of a computer or the like to calculate the value of the total energy (elastic energy+plastic energy) from the product of pushing-in load of penetrator and pushing-in depth of penetrator, and the value of elastic energy from the product of load during the course of restoration from which the pushing-in load is removed, and returned distance (depth).

The conditions for measuring the total energy and elastic energy are not specifically limited, but can be properly and optionally determined in accordance with the shape of the penetrator, type of the measuring instrument. For instance, in the case of measuring the universal hardness by the use of the aforesaid ultracompact hardness meter ( manufactured by Fischer Corp. under the trade name H-100V ), said hardness can be measured by gradually pushing a penetrator in the surface of the the toner carrier under the measuring conditions as described hereinafter, maintaining a prescribed load for about 60 seconds, thereafter removing the load, and then calculating the aforesaid total energy and elastic energy.

Example of Measuring Conditions

Penetrator: diamond made quadrangular pyramid penetrator having an opposite plane angle of 136 deg.
Initial load: 0.02 $mN/mm^2$
Maximum load: 100 to 400 $mN/mm^2$
Load applying rate: 100/60 $mN/mm^2$/sec.
Creeping time at maximum load: 60 sec.

In the case of measuring the above-mentioned universal hardness, the residual difference in deformation on the surface of the object to be measured (creep value) is obtainable by pushing a penetrator, while increasing the push-in load up to a prescribed load, maintaining the prescribed load environment, and subsequently decreasing the load on the penetrator. That is to say, assuming that the object to be measured is a perfect elastic body, when a penetrator is pushed in said object to be measured by increasing the load, followed by the removal of the load by decreasing the same, then the surface of said object is restored to the original state, and the penetrator is returned to the original position, that is, a pushed-in depth of zero. On the contrary, if the object to be measured is a perfect plastic body, even when a penetrator is pushed in said object to be measured, followed by the removal of the load, the surface of said object remains non-restored, and the penetrator is not returned to the original position. By utilizing the phenomenon, the deformation quantity of the object to be measured is obtainable from the difference in the position between the start of measurement and the completion thereof under a standardized condition including arbitrary measurement conditions.

The toner carrier (II) according to the present invention undergoes surface modification so that the 60 sec. creep value is made to be at most 10.0 $\mu$m, preferably at most 8.5 $\mu$m, said value being obtained from the measurement of deformation restoration behavior of the surface of said toner carrier under measuring condition at a definite load of 100 mN/mm$^2$ at the time of measuring the universal hardness of the surface thereof as described before. The conditions of measuring the creep value are not specifically limited except by the maximum load and creeping time at maximum load, but can be properly optionally determined in accordance with the shape of the penetrator and the type of the measuring instrument. The creep value measured at a different maximum load can be applicable as an evaluation standard as well, provided that the foregoing prescribed creep value is properly modified. In the case where the object of measurement is a toner binder seed (styrene acrylate copolymer resin or polyester resin) which is generally used at the present time, it is possible to standardize the creep value under the foregoing conditions. In the case of measuring the universal hardness by the use of the ultracompact hardness meter (manufactured by Fischer Corp. under the trade name H-100V), it is possible to exemplify the conditions same as the foregoing.

In the toner carrier (I) according to the present invention the above-mentioned elastic energy and plastic energy on the surface thereof need only to satisfy the formula (1). Thus the structure and form thereof are not specifically limited. As illustrated in FIG. 1, the toner carrier (I) usually comprises a highly electroconductive shaft 2, an electroconductive elastic layer 3 placed outside thereof and further a coating layer 4 formed on the surface of the layer 3.

In the toner carrier (II) according to the present invention the creep value obtained from the measurement of deformation restoration behavior of the surface of said toner carrier under measuring condition at a definite load of 100 mN/mm$^2$ at the time of measuring the universal hardness of the surface thereof, needs only to satisfy the above-mentioned range. Thus the structure and form thereof are not specifically limited. As illustrated in FIG. 1, the toner carrier (II) usually comprises a highly electroconductive shaft 2, an electroconductive elastic layer 3 placed outside thereof and further a coating layer 4 formed on the surface of the layer 3.

In addition, in the toner carrier (III) according to the present invention, the universal hardness in the vicinity of the surface thereof, that is, in a region having a depth of at most 5 $\mu$m from the surface under measuring condition at a definite load applying rate of 100/60 (mN/mm$^2$/sec.) upon measuring the universal hardness of the surface thereof is at most 3N/mm$^2$, preferably in the range of 0.1 to 1.5 N/mm$^2$. The toner carrier (III) having the universal hardness exceeding 3 N/mm$^2$ leads to excessive deterioration of a toner, thereby making it difficult to assure steadily high quality image for a long period of time. In other words, the universal hardness determined under the aforesaid conditions is an index which directly evaluates the hardness in the region having a depth of at most 5 $\mu$m from the surface of the toner carrier, and is extremely effective in judging the physical properties of the toner carrier.

In the toner carrier (III) according to the present invention the properties on the surface thereof needs only to satisfy the value of the universal hardness as defined hereinabove. Hence, the structure and form thereof are not specifically limited. As illustrated in FIG. 1, the toner carrier (III) usually comprises a highly electroconductive shaft 2, an electroconductive elastic layer 3 placed outside thereof and further a coating layer 4 formed on the surface of the layer 3.

Any of shafts is usable therefor, provided that it has good electroconductivity, and use is usually made of a metallic shaft such as a core metal composed of a metallic solid body and a metallic cylinder made by hollowing out a core metal.

There is used as the electroconductive elastic layer 3, an elastic body made of proper rubber which is imparted with electroconductivity by adding an electroconductivity imparting agent. Usable rubber therefor is not specifically limited, but is preferably exemplified by nitrile rubber, ethylene propylene rubber, styrene butadiene rubber, butadiene rubber, isoprene rubber, natural rubber, silicone rubber, urethane rubber, acrylic rubber, chloroprene rubber, butyl rubber and epichlorohydrin rubber. The above-exemplified rubber may be used alone or in combination with at least one other. Of these are preferably usable ethylene propylene rubber, butadiene rubber, silicone rubber and urethane rubber. Moreover, there is also preferably usable a mixture of any of the aforesaid preferably usable rubber and an other rubber material. In particular, a resin having a urethane bond is preferably usable in the present invention.

The electroconductivity imparting agent is classified into ionic electroconductivity imparting agent and electronic electroconductivity imparting agent. Examples of the ionic electroconductivity imparting agent include ammonium salts such as perchlorates, chlorates, hydrochlorides, bromates, iodates, borofluorides, sulfates, ethyl sulfates, carboxylates, sulfonates and the like, of any of tetraethyl ammonium, tetrabutyl ammonium, lauryltrimethyl ammonium, stearyltrimethyl ammonium, octadecytrimethyl ammonium, dodecyltrimethyl ammonium, hexadecyltrimethyl ammonium, benzyltrimethyl ammonium, modified aliphatic dimethylethyl ammonium and the like; perchlorates, chlorates, hydrochlorides, bromates, iodates, borofluorides, trifluoromethyl sulfates, sulfonates and the like, of any of alkali metals such as lithium, sodium and potassium, or alkaline earth metals such as calcium and magnesium.

Examples of the electronic electroconductivity imparting agent include electroconductive carbon black such as ketchen black and acetylene black; carbon black for rubber such as SAF, ISAF, HAF, FEF, GPF, SRF, FT and MT; oxidation treated carbon black for ink; thermally cracked carbon black; graphite; electro-conductive metal oxide such as tin oxide, titanium oxide and zinc oxide; and metals such as nickel and copper. The above-exemplified electroconductivity imparting agent may be used alone or in combination with at least one other. The blending amount thereof is not specifically limited. In the case of the ionic electroconductivity imparting agent, the blending amount thereof is usually 0.01 to 5.00 parts by weight, preferably 0.05 to 2.00 parts by weight based on 100 parts by weight of the rubber component. In the case of the electronic electroconductivity imparting agent, the blending amount thereof is usually 1.00 to 50.00 parts by weight, preferably 5.00 to 40.00 parts by weight based on 100 parts by weight of the rubber component. On the basis of the foregoing blending amount, the specific volume resistance of the electroconductive elastic layer is regulated to $10^3$ to $10^{10}$ Ω·cm, preferably $10^4$ to $10^8$ Ω·cm.

The above-mentioned electroconductive elastic layer may be incorporated with at need, with any of various additives such as fillers, crosslinking agents and additives for rubber.

Moreover, the electroconductive elastic layer, which is used in butt contact with an image formation body, a layer forming blade and the like, preferably has a low compression set, specifically at most 20%, preferably at most 10%. It is preferable to use as a rubber material, urethane rubber which enables to lessen the compression set.

It is preferable in the present invention to regulate the surface roughness of the electroconductive elastic layer to one to 20 μm Rz, particularly 1.5 to 18 μm Rz expressed in terms of average roughness according to JIS 10 points. An average surface roughness, when being more than 20 μm Rz, often leads to excessively high hardness of the surface of the toner carrier due to the necessity for forming a thick coating layer thereof with the result that a toner is damaged, and fixed to the image formation body and layer forming blade, thereby causing defective images. On the other hand, an average surface roughness, when being less than 1 μm Rz, brings about a fear of excessively small average surface roughness of the toner carrier when equipped with a coating layer and also decrease in the amount of supported toner, causing lowering in image density.

The aforesaid surface roughness is the value which is measured by means of a surface roughness tester (manufactured by Tokyo Precision Co.,Ltd. under the trade name Surfcom 590A) in the direction perpendicular to the shaft at a measuring length of 2.4 mm, a measuring speed of 0.3 mm sec. and a cut off wave length of 0.8 mm in the directions of both shaft and circumference at least 300 portions so as not to cause deviation (the same applies hereinafter).

It is preferable to equip the toner carrier according to the present invention with a coating layer composed of a resin, etc. and placed on the surface of the electroconductive elastic layer to control the charging property and adhesivity, decrease the force of friction between the toner carrier and the image formation body, layer forming blade and the like, and to prevent the image formation body from being polluted by elastic bodies. Preferably the coating layer is constituted of a material containing a resin having a glass transition temperature of 10° C. or lower, particularly −5 to 0° C. The use of a resin having a glass transition temperature higher than 10° C. brings about a fear of marked variation in physical property of the coating layer, and considerable dispersion of quantities of transport and charging of a toner, and raises such problems that the coating layer is made brittle and impossible to follow the deformation of the electroconductive elastic layer, whereby the coating layer becomes more prone to be cracked.

The aforesaid coating layer has a dynamic modulus of elasticity E' in the range of $10^7$ to $10^{9.8}$ dyn/cm$^2$, preferably $10^8$ to $10^{9.6}$ dyn/cm$^2$, and a loss tangent tanδ of at most 0.7 preferably in the range of 0.05 to 0.5. The loss tangent is the ratio of dynamic loss E" to the dynamic modulus of elasticity E' when a specimen undergoes a stress.

Preferably, the coating layer has a solvent insoluble portion of at least 70% by weight, said solvent being good solvent such as acetone. The solvent insoluble portion of less than 70% by weight brings about a fear of migration of single molecular weight equivalent during long-term standing still at portions where the toner carrier comes in butt contact with the image formation apparatus, layer forming blade and the like, thus causing defective image such as black horizontal lines on the image. In this respect, the solvent insoluble portion is preferably at least 80% by weight.

The resin usable for the formation of the coating layer is preferably exemplified by a crosslinkable resin and the like. By the term crosslinkable resin is meant the resin which self-crosslinks by heat, a catalyst, air (oxygen), moisture (water), electron beam or the like, and the resin which crosslinks by the reaction with a crosslinking agent or an other crosslinkable resin.

Examples of such crosslinkable resin include fluororesin, polyamide resin, acrylurethane resin, alkyd resin, phenolic resin, melamine resin, silicone resin, polyurethane resin, polyester resin, polyvinylacetal resin, epoxy resin, polyether resin, amino resin, urea resin, acrylic resin, acrylic modified silicone resin, styrene-butadie resin and a mixture thereof, each bearing a reactive group such as hydroxyl group, carboxyl group, acid anhydride group, amino group, imino group, isocyanate group, methylol group, alkoxymethyl group, aldehyde group, mercapto group, epoxy group and unsaturated group.

Of these resins, there are preferably usable fluororesin, polyamide resin, acrylurethane resin, alkyd resin, phenolic resin, melamine resin, silicone resin, polyurethane resin, polyester resin, polyvinylacetal resin, epoxy resin, acrylic resin, acrylic modified silicone resin, styrene-butadie resin and a mixture thereof, especially fluororesin, polyamide resin, alkyd resin, phenolic resin, melamine resin, silicone resin, polyurethane resin, polyester resin, acrylic resin, acrylic modified silicone resin, styrene-butadie resin and a mixture thereof from the viewpoints of charging performance for a toner, antifoulancy for a toner, decrease in force of friction with other members and antifoulancy for an image formation body. Further, there is usable a mixture of any of the exemplified resins and an other resin.

The catalyst usable for the crosslinking is exemplified by a radical catalyst, an acid catalyst and basic catalyst. The crosslinking agent includes compounds which each bears at least two reactive groups in one molecule, the reactive group being exemplified by hydroxyl group, carboxyl group, acid anhydride group, amino group, imino group, isocyanate group, methylol group, alkoxymethyl group, aldehyde group, mercapto group, epoxy group and unsaturated group, which have each a molecular weight of at most 1000, preferably at most 500, and which is exemplified by polyol compounds, polyisocyanate compounds, polyaldehyde compounds, polyamine compounds and polyepoxy compounds.

The coating layer according to the present invention, which comprises any of the above-exemplified resins as a principal component, may further be blended with an additive such as an antistatic agent, a lubricant and an other resin for the purpose of decreasing the force of friction with an other member, and imparting electroconductivity to the electroconductive elastic layer.

It is preferable in the toner carrier according to the present invention to set the specific volume resistance of at least the outermost layer of the coating layer on a value higher than that of the electroconductive elastic layer with a view to regulate the resistance of the toner carrier. Specifically the specific volume resistance of the foregoing outermost layer is set on preferably $10^7$ to $10^{16}$ Ω·cm, more preferably $10^{10}$ to $10^{13}$ Ω·cm. The specific volume resistance can be regulated by adding in cured resin, an ionic electroconductivity imparting agent or an electronic electroconductivity imparting agent, which may be selected for use from the electroconductivity imparting agents that are used in the electroconductive elastic layer as described hereinbefore.

The specific volume resistance of the toner carriers (I), (II) and (III) according to the present invention is set each on preferably $10^6$ to $10^{12}$ Ω·cm, more preferably $10^7$ to $10^{10}$ Ω·cm. The surface roughness of the toner carriers equipped with the coating layer formed thereon is set each on at most 20 μm Rz, preferably one to 20 μm Rz, particularly preferably one to 15 μm Rz expressed in terms of average roughness according to JIS 10 points. An average surface roughness, when being more than 20 μm Rz, often leads to excessively small charging quantity, causing reversely charged toner and image fogging. On the other hand, an average surface roughness, when being less than one μm Rz, brings about a fear of excessively small quantity of supported toner, thereby causing lowering in image density.

A method for forming the above-mentioned coating layer is not specifically limited, but usually comprises the steps of preparing a coating solution by dissolving or dispersing in a proper solvent, the aforesaid resin to be used for forming the coating layer, the crosslinking agent and at need, any of various additives; applying the resultant coating solution onto the electroconductive elastic layer by a dipping method, roll coater method, doctor blade method, spray method or the like; and thereafter drying and curing the coating at ordinary temperature or an elevated temperature in the range of 50 to 170° C.

The preferable solvent to be used for preparing the coating solution for use in forming the coating layer is exemplified by alcohol based solvents such as methanol, ethanol, isopropanol and butanol; ketone based solvents such as acetone and methyl ethyl ketone; aromatic hydrocarbon based solvents such as toluene and xylene; aliphatic hydrocarbon based solvents such as hexane; alicyclic hydrocarbon based solvents such as cyclohexane; ester based solvents such as ethyl acetate; ether based solvents such as isopropyl ether and tetrahydrofuran; amide based solvents such as dimethyl sulfoamide; halogenated solvents such as chloroform and dichloroethane; and mixed solvents of these solvents. The above-exemplified solvents may be properly optionally selected for use according to the solubility of the resin to be used without specific limitation.

The foregoing coating layer has a thickness of preferably 1 to 50 μm, more preferably 2 to 30 μm The thickness thereof, when being smaller than the above lower limit, brings about local discharge and liability to generation of white horizontal lines on an image, whereas the thickness, when being larger than the above upper limit, often brings about excessively hard toner carrier, damage to a toner and fixing of the toner to the image formation body and layer forming blade, thus causing defective images.

With regard to the hardness of the toner carriers (I), (II) and (III) according to the present invention, it is a general procedure to set the Asker C hardness on 35 to 85 degrees, in particular 37 to 80 degrees. The Asker C hardness, when exceeding 85 degrees, brings about a fear of failure to carry out favorable image formation due to decreased area of contact with the image formation body and besides, often gives rise to damage to a toner and fixing of the toner to the image formation body and layer forming blade, thus causing defective images. On the contrary, the Asker C hardness, when being unreasonably low, often leads to excessively high friction between the image formation body and the layer forming blade, causing defective images such as jitter.

Major characteristic of the toner carrier (I) according to the present invention resides in the optimized relation between the elastic energy and plastic energy in the vicinity of the surface of the toner carrier. In addition, it is preferable that the above-mentioned Asker C hardness thereof be regulated to 50 to 80 degrees. Specifically, the Asker C hardness, when being lower than 50 degrees, makes it difficult to regulate the above-mentioned Z value within the prescribed range in an appropriate material system of the toner carrier. The cause is presumed to be macroscopic plastic-deformation which is generated by that when the hardness of the toner carrier in whole is so lowered as to greatly deviate from a proper region, the influence of the softness thereof is actualized over the contribution due to viscoelastic characteristics in the vicinity of the surface thereof.

Figure 2:
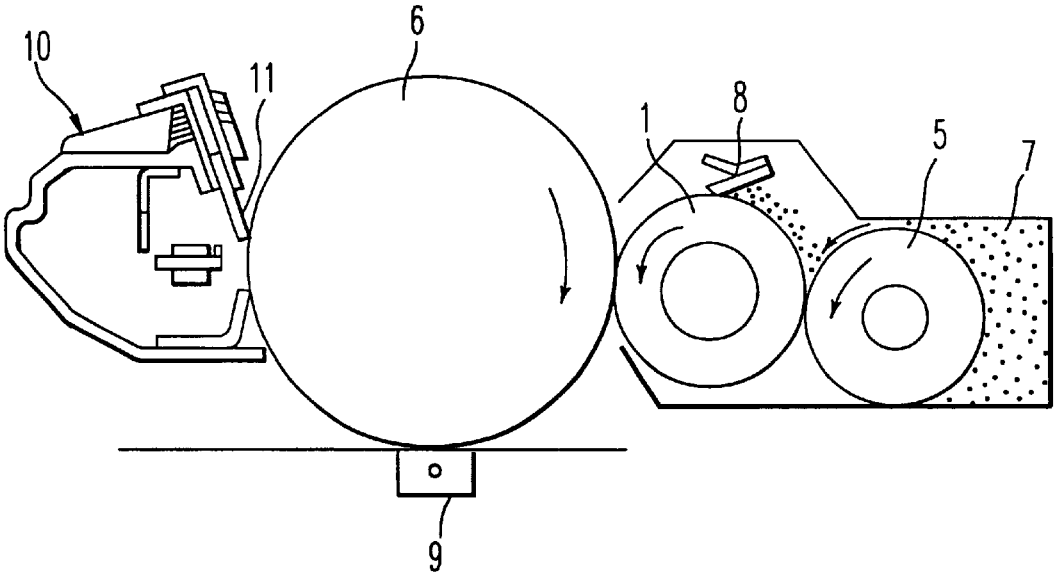
FIG. 2 is a schematic cross-sectional view of an example of an image formation apparatus according to the present invention.

The toner carriers (I), (II) and (III) according to the present invention are each utilized as a toner carrier for a developing roller or the like in an image formation apparatus of electrophotographic equipment, etc. As illustrated in FIG. 2, a toner carrier according to the present invention is placed as the developing roller 1 between the toner application roller 5 for supplying a toner and the image formation body 6 such as a photosensitive drum preserving an electrostatic latent image; and the toner 7 is supported on the toner application roller 5, arranged into uniform thin film by the layer forming blade 8, supplied from the thin film to the image formation body 6, and allowed to adhere to an latent image on the image formation body 6, whereby the latent image is visualized.

The image formation apparatus which uses the toner carrier (I), (II) or (III) according to the present invention is not specifically limited, provided that the apparatus is such that is equipped with the toner carrier which supports a toner on the surface thereof to form thin layer of the toner and in this state, forms a visible image on the image formation body. For instance, the image formation apparatus may be such an apparatus in which paper sheets such as paper, OHP paper sheet or the like is used as an image formation body, and the toner supported on the toner carrier is made to jump over directly onto the image formation body through the holes made in a control electrode so as to directly form an image on the paper or OHP paper sheet.

The toner to be supported on the toner carrier (I), (II) or (III) according to the present invention is preferably a non-magnetic unary developer, but a magnetic unary developer is also usable. For instance, also in the case of performing white and black image printing by the use of a magnetic unary developer, it is possible to favorably use the toner carrier and the image formation apparatus each according to the present invention.

As described in detail hereinbefore, the toner carrier (I) according to the present invention is capable of suppressing toner damage, preventing another evilness caused by suppression of toner damage such as defective image, and affording steadily favorable image even in a working environment which has hitherto been said to be more prone to cause defective image, including long-term preservation and long-term service by optimizing the relation between elastic energy and plastic energy in the vicinity of the surface of the toner. Accordingly, the toner carrier (I) is favorably usable for various image formation apparatuses.

Further, the toner carrier (II) according to the present invention is capable of suppressing the toner carrier from being scraped off by agglomerated toner attributable to toner damage, preventing the generation of a defect such as toner leakage, and affording steadily favorable image even in a working environment which has hitherto been said to be more prone to cause defective image, including long-term preservation and long-term service by optimizing the plastic deformation quantity of the toner carrier with 60 sec. creep value obtained under measuring condition at a definite load of 100 mN/mm$^2$ at the time of measuring the universal hardness of the surface of the toner carrier. Hence, the toner carrier (II) is favorably usable for various image formation apparatuses.

Furthermore, the toner carrier (III) according to the present invention is capable of suppressing the deterioration of the toner, and thereby affording steadily high quality images free from any unevenness in image for a long period of time even if continuously high speed printing is carried out. Accordingly, any of various image formation apparatuses equipped with the toner carrier (III) is characterized by high performance and is excellent in durability.

In the following, the present invention will be described in more detail with reference to comparative examples and working examples, which however shall never limit the present invention thereto.

EXAMPLE 1

By the use of a mixer, a polyol composition was prepared by mixing 100 parts by weight (hereinafter abbreviated to "parts"), of polyether polyol having a molecular weight of 5000 and a hydroxyl functionality (OH value) of 33, 1.0 part of 1,4-butanediol, 0.5 part of nickel acetylacetonate and 0.01 part of dibutyltin laurate and 2.0 parts of acetylene black.

The polyol composition thus obtained was defoamed by stirring under reduced pressure, incorporated with 7.5 parts of urethane modified MDI (diphenylmethane-4,4'-diisocyanate) with stirring for 2 minutes, cast into a mold in which a metallic shaft had been placed and which had been heated in advance to 110° C., and cured at 110° C. for 2 hours, thus forming an electro-conductive elastic body on the outer periphery of the metallic shaft to prepare a roller. The surface of the roller thus obtained was polished to an average surface roughness of 15.0 $\mu$m Rz expressed in terms of average roughness according to JIS 10 points. The surface roughness was measured by means of a surface roughness tester (manufactured by Tokyo Precision Co., Ltd. under the trade name Surfcom 590A) {in all the following comparative examples and working examples, average surface roughness was measured in the same manner as the foregoing).

Subsequently, a coating solution having a total solid concentration of 15% by weight was prepared by diluting a solution of alcohol-soluble resol type phenol with ethanol as the solvent, the above-prepared electroconductive elastic roller was immersed in the resultant coating solution, drawn up from the solution, and heated at 110° C. for 4 hours to form a roller type toner carrier having the cured coating layer same as that illustrated in FIG. 1. In Table 1 are given the dynamic modulus of elasticity E', loss tangent tanδ, rate of solvent insoluble portion and thickness each of the resultant coating layer and average surface roughness Rz according to JIS 10 points of the resultant toner carrier.

The Asker C hardness of the surface of the toner carrier was 63.0 degrees. In addition, by the use of a ultracompact hardness meter (manufactured by Fischer Corp. under the trade name H-100V), investigation was made on the behavior of surface deformation energy under the following measuring conditions in which a load was applied and removed. As a result, the toner carrier had a Z value of 0.9363.

Measuring Conditions

Penetrator: diamond made quadrangular pyramid penetrator having an opposite plane angle of 136 deg.
Initial load: 0.02 mN/mm$^2$
Maximum load: 100 mN/mm$^2$
Load applying rate: 100/60 mN/mm$^2$/sec.
Creeping time at maximum load: 60 sec.

By using the toner carrier as the developing roller in the developing unit as illustrated in FIG. 2, setting a development bias and a blade bias on −400 V and −600 V, respectively, using a negatively chargeable non-magnetic unary toner having an average particle diameter of 7 $\mu$m, and rotating the developing roller at a peripheral linear velocity of 60 mm/sec., image manifestation was carried out by means of reversal development to evaluate images on white ground, half tone and black ground. Thus, evaluations were made of initial images and durable images each in 5 sheets to grasp the performance tendency. Subsequently evaluations were made of durable images by the use of printed images after the completion of continuous 4% printing of 10000 sheets {in all the following comparative examples and working examples, printing conditions and evaluation method were each the same as the foregoing).

As a result, it was possible to obtain satisfactory printing results in each of the images. Moreover, the aforesaid toner carrier as the developing roller was allowed to stand for one week under the environmental conditions including an ambient temperature of 22.5° C. and a humidity of 50% in a state of being incorporated as such in the printer. Thereafter, half tone images were printed with a result that no trace likely to be defective was generated anywhere on the images.

EXAMPLE 2

A roller was prepared in the same manner as in Example 1 except that there were used 10 parts of 1,4-butanediol to be added and 20 parts of urethane modified MDI to be added.

Subsequently, a coating solution was prepared which had a total solid concentration of 12.5% by weight and a specific volume resistance on film forming regulated to $1.08\times10^8$ Ω·cm by adding acetylene black as an electroconductivity imparting agent in a solution of polyether polyurethane, the resultant electroconductive elastic roller was immersed in the resultant coating solution, drawn up from the solution, and air dried at 100° C. for 30 minutes. Further, a coating solution having a total solid concentration of 15% by weight was freshly prepared by blending an oil free alkyd compound with isobutyl ether melamine resin at a blending ratio of 75/25 in terms of solid weight, and diluting the resultant mixture with methyl ethyl ketone as the solvent. The temperature of the air dried electroconductive elastic roller was returned to room temperature, thereafter the roller was immersed in the coating solution freshly prepared, drawn up from the solution, and heated at 110° C. for 4 hours to form a roller type toner carrier having the cured coating layer same as that illustrated in FIG. 1. In Table 1 are given the dynamic modulus of elasticity E', loss tangent tanδ, rate of solvent insoluble portion and thickness each of the resultant coating layer and an average surface roughness Rz according to JIS 10 points of the resultant toner carrier.

The Asker C hardness of the surface of the toner carrier was 64.0 degrees. In addition, investigation was made on the behavior of surface deformation energy in the same manner and under the measuring conditions each same as in Example 1. As a result, the toner carrier had a Z value of 0.8993.

By the use of the toner carrier as the developing roller, evaluations were made of the images on white ground, half tone and black ground. As a result, it was possible to obtain satisfactory printing results in each of the images. After the completion of durable printing of 10000 sheets, no defect was generated, including streaky wear on the surface of the toner carrier and toner leakage. Moreover, the aforesaid toner carrier as the developing roller was allowed to stand for one week under the environmental conditions including an ambient temperature of 22.5° C. and a humidity of 50% in a state of being incorporated as such in the printer. Thereafter, half tone images were printed with a result that no trace likely to be defective was generated anywhere on the images.

Comparative Example 1

A roller was prepared in the same manner as in Example 1 except that use was made of a polyalkylene polyol which had a molecular weight of 5500 and an OH value of 2.8 in place of the polyether polyol having a molecular weight of 5000, and 13 parts of urethane modified MDI to be added.

Subsequently, a coating solution was prepared which had a total solid concentration of 25.0% by weight and a specific volume resistance on film forming regulated to $8.08\times10^7$ Ω·cm by adding acetylene black as an electroconductivity imparting agent in a solution of a urethane modified acrylic compound, the above-prepared electroconductive elastic roller was immersed in the resultant coating solution, drawn up from the solution, and heated at 130° C. for 4 hours to form a roller type toner carrier having the cured coating layer same as that illustrated in FIG. 1. In Table 1 are given the dynamic modulus of elasticity E', loss tangent tanδ, rate of solvent insoluble portion and thickness each of the resultant coating layer and an average surface roughness Rz according to JIS 10 points of the resultant toner carrier.

The Asker C hardness of the surface of the toner carrier was 60.5 degrees. In addition, investigation was made on the behavior of surface deformation energy in the same manner and under the measuring conditions each same as in Example 1. As a result, the toner carrier had a Z value of 0.5500.

By the use of the toner carrier as the developing roller, evaluations were made of the images on white ground, half tone and black ground. As a result, it was possible to obtain satisfactory printing results in the initial images, but fogging occurred on white ground print in the durable images. After the completion of durable printing of 10000 sheets, there were generated such defects as streaky wear on the surface of the toner carrier and toner leakage.

Comparative Example 2

A roller was prepared in the same manner as in Example 1 except that use was made of a polyalkyd polyol which had a molecular weight of 6000 and an OH value of 3.0 in place of the polyether polyol having a molecular weight of 5000, and hydrogenated MDI was used in place of urethane modified MDI.

Subsequently, the roller was coated with a coating solution and heat treated in the same manner as in Example 2 except that the coating solution was prepared which had a total solid concentration of 15.0% by weight and a specific volume resistance on film forming regulated to $1.08\times10^8$ Ω·cm by adding acetylene black as an electroconductivity imparting agent in a solution of polyether polyurethane to form a roller type toner carrier having the cured coating layer same as that illustrated in FIG. 1. In Table 1 are given the dynamic modulus of elasticity E', loss tangent tanδ, rate of solvent insoluble portion and thickness each of the resultant coating layer and an average surface roughness Rz according to JIS 10 points of the resultant toner carrier.

The Asker C hardness of the surface of the toner carrier was 63.0 degrees. In addition, investigation was made on the behavior of surface deformation energy in the same manner and under the measuring conditions each same as in Example 1. As a result, the toner carrier had a Z value of 0.6011.

By the use of the toner carrier as the developing roller, evaluations were made of the images on white ground, half tone and black ground. As a result, it was possible to obtain satisfactory printing results in each of the images. After the completion of durable printing of 10000 sheets, however, such defects were generated as streaky wear on the surface of the toner carrier and toner leakage. Moreover, the aforesaid toner carrier as the developing roller was allowed to stand for one week under the environmental conditions including an ambient temperature of 22.5° C. and a humidity of 50% in a state of being incorporated as such in the printer. Thereafter, half tone images were printed with a result that there were generated streaky defective images attributable to traces of pressure contact.

TABLE 1

| | Dynamic modulus of elasticity E' (dyn/cm$^2$) | Loss tangent tan δ | Rate of solvent insoluble portion | Thickness (μm) | Average roughness (μm) |
|---|---|---|---|---|---|
| Example 1 | 9.59 | 0.15 | 0.985 | 5.8 | 10.60 |
| Example 2 | | | | | |
| lower layer | 9.10 | 0.31 | 0.398 | 17.6 | — |
| upper layer | 9.57 | 0.11 | 0.973 | 4.5 | 5.97 |
| Comparative Example 1 | 8.33 | 0.48 | 0.958 | 25.9 | 3.85 |
| Comparative Example 2 | | | | | |
| lower layer | 9.10 | 0.31 | 0.398 | 65.3 | — |
| upper layer | 9.57 | 0.11 | 0.973 | 4.5 | 3.24 |

EXAMPLE 3

A measurement was made of 60 sec. creep value for the toner carrier same as in Example 1 by the use of a ultra-compact hardness meter (manufactured by Fischer Corp. under the trade name H-100V) under measuring condition at a definite load of 100 mN/mm$^2$ by applying the load thereto and then removing therefrom. As a result, the 60 sec. creep value was 3.69 μm.

EXAMPLE 4

A measurement was made of 60 sec. creep value for the toner carrier same as in Example 2 by the use of a ultra-compact hardness meter (manufactured by Fischer Corp. under the trade name H-100V) under measuring condition at a definite load of 100 mN/mm$^2$ by applying the load thereto and then removing therefrom. As a result, the 60 sec. creep value was 4.32 μm.

Comparative Example 3

A measurement was made of 60 sec. creep value for the toner carrier same as in Comparative Example 1 by the use of a ultra compact hardness meter (manufactured by Fischer Corp. under the trade name H-100V) under measuring condition at a definite load of 100 mN/mm$^2$ by applying the load thereto and then removing therefrom. As a result, the 60 sec. creep value was 13.01 $\mu$m.

Comparative Example 4

A measurement was made of 60 sec. creep value for the toner carrier same as in Comparative Example 2 by the use of a ultra compact hardness meter (manufactured by Fischer Corp. under the trade name H-100V) under measuring condition at a definite load of 100 mN/mm$^2$ by applying the load thereto and then removing therefrom. As a result, the 60 sec. creep value was 15.30 $\mu$m.

EXAMPLE 5

Aurethane composition was prepared by mixing 100 parts of polyether polyol having an OH value of 33.0 ( manufactured by Sumitomo Bayer Co.,Ltd. under the trade name SBU Polyol 0610), 1.0 part of silicone oil modified with a branched alcohol having siloxane bonds in the main chain ( manufactured by Dow Corning Toray Corporation under the trade name SF 8428), 0.01 part of dibutyltin laurate, 1.0 part of 1,4-butanediol (manufactured by Tosoh Corporation under the trade name 1, 4-B.D.), 0.5 part of an alkyldiphenylamine (manufactured by Seikoh Chemicals Co.,Ltd. under the trade name Steara STAR ) and 3.5 parts of acetylene black ( manufactured by Denki Kagaku Kogyo K.K. under the trade name Denka Black), defoaming the resultant mixture with stirring for 30 minutes under reduced pressure, thereafter incorporating therein 16.5 parts of urethane modified MDI (NCO: 23.0% by weight, manufactured by BASF·INOAC Polyurethane Co.,Ltd. under the trade name Ipranate MP102), and defoaming the resultant mixture under reduced pressure with stirring for 3 minutes.

The resultant urethane composition was cast into a mold in which a metallic shaft had been placed and which had been heated in advance to 90° C., cured at 90° C. for 16 hours, thus forming an electroconductive elastic body on the outer periphery of the metallic shaft to prepare a roller.

Subsequently, a resin solution having a concentration of 10% by weight was prepared by diluting with a mixed solvent of methyl ethyl ketone and dioxane, polyuethane to be used as a binder in which the polyol component was polyester base (condensation system of adipic acid and 1,4-butanediol) and isocyanate was composed of methylenebisphenyl diisocyanate and which had a number average molecular weight Mn of 80,000 and a weight average molecular weight Mw of 140,000 each expressed in terms of polystyrene. Subsequently, a coating solution was prepared by adding to the resultant resin solution, HFC carbon for coloring (specific surface area of 260 m$^2$/g, and oil absorption of 40 ml/100 g) in an amount of 13 parts based on 100 parts of the polyuethane by means of dispersion mixing through Reddevyl method. A first resinous coating layer was formed on the above-prepared roller through immersion method by using the resultant coating solution, and was dried at 100° C. for one hour.

Further, a coating solution was prepared by dissolving a resol type phenol resin (manufactured by Sumitomo Dures Co.,Ltd. under the trade name PR50781) in ethanol so as to achieve a concentration of 15% by weight, adding glass beads to the resultant solution and thereafter, shaking the mixed solution with a paint shaker for 6 hours.

An outermost resinous coating layer was formed on the above prepared roller having the first resinous coating layer formed thereon through immersion method by using the resultant coating solution, and was dried at 100° C. for 4 hour.

Subsequently, measurements were made of Asker C hardness of the surface of the roller (toner carrier) equipped with both the first resinous coating layer and the outermost resinous coating layer, and of universal hardness at a prescribed depth from the surface of the toner carrier by the use of a ultracompact hardness meter (manufactured by Fischer Corp. under the trade name H-100V) under the following measuring conditions.

Measuring Conditions

Penetrator: diamond made quadrangular pyramid penetrator having an opposite plane angle of 136 deg.
Maximum load: 100 mN/mm$^2$
Load applying rate: 100/60 [mN/mm$^2$/sec.]

By using the tone carrier as the developing roller in the developing unit as illustrated in FIG. 2, setting a development bias and a blade bias on −400 V and −600 V, respectively, using a negatively chargeable non-magnetic unary toner having an average particle diameter of 7 $\mu$m, and rotating the developing roller at a peripheral linear velocity of 60 mm/sec., image manifestation was carried out by means of reversal development to evaluate images on white ground, half tone and black ground. Thus, evaluations were made of initial images and durable images each in 5 sheets to grasp the performance tendency. Subsequently evaluations were made of durable images by the use of printed images after the completion of continuous 5% printing of 10000 sheets {in all the following comparative examples and working examples, printing conditions and evaluation method were each the same as the foregoing).

As a result, it was possible to obtain satisfactory printing results in each of the images. Moreover, the aforesaid toner carrier as the developing roller was allowed to stand for one week under the environmental conditions including an ambient temperature of 2.5° C. and a humidity of 50% in a state of being incorporated as such in the printer. Thereafter, half tone images were printed with a result that no trace likely to be defective was generated anywhere on the images. The results are given in Table 2.

EXAMPLE 6

A rubber composition was prepared by mixing 65 parts of polybutadiene rubber and 35 parts of polyisoprene rubber, adding ink carbon to the resultant mixed rubber with sufficient mixing so as to achieve 15% by weight of the carbon, and defoaming the resultant mixture under reduced pressure with stirring for 3 minutes.

The resultant ruber composition was cast into a mold in which a metallic shaft had been placed and which had been heated in advance to 90° C., and cured at 90° C. for one hour, thus forming an electroconductive elastic body on the outer periphery of the metallic shaft to prepare a roller.

Subsequently, in the same manner as in Example 5, there were formed a first resinous coating layer and an outermost resinous coating layer. Further, measurements were made of properties of the roller (toner carrier) thus prepared in the same manner as in Example 5. The results are given in Table 2.

Comparative Example 5

By the use of a mixer, a polyol composition was prepared by mixing 100 parts by weight of polyether polyol which had a molecular weight of 2500 and an OH value of 47.1 and 2.85 parts of acetylene black.

The polyol composition thus obtained was defoamed by stirring under reduced pressure, incorporated with 13.33 parts of crude MDI (crude meta-xylene diisocyanate) (NCO: 31.7%) with stirring for 2 minutes, and was incoporated with 0.001 part of dibutyltin laurate with stirring for 3 minutes.

The resultant mixture was cast into a mold in which a metallic shaft had been placed and which had been heated in advance to 90° C., and cured at 90° C. for 12 hours, thus forming an electroconductive elastic body on the outer periphery of the metallic shaft to prepare a roller.

Next, a resin solution was prepared by blending an oil-free alkyd resin (manufactured by Dainippon Ink and Chemicals, Inc. under the trade name M6402 ) with melamine resin ( manufactured by Dainippon Ink and Chemicals, Inc. under the trade name L145 ) at a blending ratio of 75/25 in terms of solid weight, and dissolving the resultant mixture in methyl ethyl ketone so as to achieve a total resin concentration of 25% by weight. The roller was immersed in the resin solution thus prepared, drawn up from the solution, and heated at 110° C. for 4 hours to form a roller (toner carrier) equipped with the crosslinkingly cured layer (coat). Further, measurements were made of properties of the roller (toner carrier) thus prepared in the same manner as in Example 5. The results are given in Table 2.

Comparative Example 4

A rubber composition was prepared by mixing 65 parts of polybutadiene rubber and 35 parts of polyisoprene rubber, adding ink carbon to the resultant mixed rubber with sufficient mixing so as to achieve 15% by weight of the carbon, and defoaming the resultant mixture under reduced pressure with stirring for 3 minutes.

The resultant ruber composition was cast into a mold in which a metallic shaft had been placed and which had been heated in advance to 90° C., and cured at 90° C. for one hour, thus forming an electroconductive elastic body on the outer periphery of the metallic shaft to prepare a roller.

Subsequently, in the same manner as in Comparative Example 5, there was prepared a roller (toner carrier) equipped with the crosslinkingly cured layer (coat) except for a total resin concentration of 10% by weight. Further, measurements were made of properties of the roller(toner carrier) thus prepared in the same manner as in Example 5. The results are given in Table 2.

TABLE 2

| | Example | | Comparative Example | |
|---|---|---|---|---|
| | 5 | 6 | 5 | 6 |
| Substrate | PUR | rubber | PUR | rubber |
| Coat film | UR/PH two-layer | UR/PH two-layer | alkyd-melamine | alkyd-melamine |
| Asker C hardness | 74 | 65 | 74 | 85 |
| Universal hardness {N/mm$^2$} | 0.591 | 0.914 | 4.127 | 10.415 |
| Measurement depth ($\mu$m) | 4.8 | 3.84 | 4.16 | 4.67 |
| Initial totally white image | good | good | good | good |
| Initial half tone | good | good | good | good |
| Initial totally black image | good | good | good | good |
| Durable totally white image | good | good | fogging | fogging |
| Durable half tone | good | good | streak | thin spot |
| Durable totally black image | good | good | somewhat lowered density | lowered density |

{Remarks} PUR: polyurethane, UR: urethane, PH; phenol.

What is claimed is:

1. A toner carrier which supports a toner on its surface to form thin films thereof and in this state, supplies the toner to the surface of an image formation body in contact with or in close vicinity to said image formation body so as to form visible image thereon, said toner carrier having at least 0.70 of Z value, which is represented by the formula (1) obtained from deformation restoration behavior of the surface of said toner carrier at the time of measuring the universal hardness of the surface thereof:

$$Z=We/(We+Wr) \quad (1)$$

wherein We is elastic energy from among the energies in relation to the deformation of the surface thereof, said elastic energy being obtained from deformation restoration behavior of the surface of said toner carrier at the time of measuring the universal hardness of the surface thereof; and Wr is plastic energy therefrom, and wherein the Asker C hardness on the surface thereof is 50 to 80 degrees.

2. The toner carrier according to claim 1, which comprises an elastic layer and at least one coating layer installed on the surface thereof.

3. The toner carrier according to claim 2, wherein the elastic layer comprises at least one member selected from the group consisting of ethylene-propylene rubber, butadiene rubber, silicone rubber, urethane rubber and a mixed rubber of any of the foregoing rubber and rubber other than the same.

4. The toner carrier according to claim 2, wherein the elastic layer comprises urethane rubber.

5. The toner carrier according to claim 2, wherein at least one layer of the coating layer comprises at least one member selected from the group consisting of fluororesin, polyamide resin, alkyd resin, phenolic resin, melamine resin, silicone resin, polyurethane resin, polyester resin, acrylic resin, acrylic modified silicone resin, styrene-butadiene resin and a mixture of at least two thereof.

6. An image formation apparatus comprising, as a minimum requirement, a toner carrier and an image formation body on the surface of which is formed a visible image by means of a toner supplied from the toner carrier and which is in contact with or in close vicinity to the toner carrier forming a toner thin film on the surface thereof, said image formation apparatus being equipped with the toner carrier as set forth in claim 1.

7. A toner carrier which supports a toner on its surface to form thin films thereof and in this state, supplies the toner to the surface of an image formation body in contact with or in close vicinity to the image formation body so as to form visible image thereon, said toner carrier having at most 10.0 $\mu$m of 60 sec. creep value obtained from deformation restoration behavior of the surface of said toner carrier under measuring condition at a definite load of 100 mN/mm$^2$ at the time of measuring the universal hardness of the surface thereof.

8. The toner carrier according to claim 7, which comprises an elastic layer and at least one coating layer installed on the surface thereof.

9. The toner carrier according to claim 8, wherein the elastic layer comprises at least one member selected from the group consisting of ethylene-propylene rubber, butadiene rubber, silicone rubber, urethane rubber and a mixed rubber of any of the foregoing rubber and rubber other than the same.

10. The toner carrier according to claim 9, wherein the elastic layer comprises urethane rubber.

11. The toner carrier according to claim 8, wherein at least one layer of the coating layer comprises at least one member selected from the group consisting of fluororesin, polyamide resin, alkyd resin, phenolic resin, melamine resin, silicone resin, polyurethane resin, polyester resin, acrylic resin, acrylic modified silicone resin, styrene-butadiene resin and a mixture of at least two thereof.

12. The toner carrier according to claim 7, wherein the Asker C hardness on the surface thereof is 35 to 85 degrees.

13. An image formation apparatus comprising, as a minimum requirement, a toner carrier and an image formation body on the surface of which is formed a visible image by means of a toner supplied from the toner carrier and which is in contact with or in close vicinity to the toner carrier forming a toner thin film on the surface thereof, said image formation apparatus being equipped with the toner carrier as set forth in claim 7.

14. A toner carrier which supports a toner on its surface to form thin films thereof and in this state, supplies the toner to the surface of an image formation body in contact with or in close vicinity to the image formation body so as to form visible image thereon, said toner carrier having at most 3 $N/mm^2$ of universal hardness at a depth of at most 5 $\mu$m from the surface of said toner carrier under measuring condition at a definite load applying rate of 100/60($mN/mm^2$/sec.) at the time of measuring the universal hardness of the surface thereof.

15. The toner carrier according to claim 14, wherein the universal hardness at a depth of at most 5 $\mu$m from the surface of said toner carrier is 0.1 to 1.5 $N/mm^2$.

16. The toner carrier according to claim 14, which comprises an elastic layer and at least one coating layer installed on the surface thereof.

17. The toner carrier according to claim 16, wherein the elastic layer comprises at least one member selected from the group consisting of ethylene-propylene rubber, butadiene rubber, silicone rubber, urethane rubber and a mixed rubber of any of the foregoing rubber and rubber other than the same.

18. The toner carrier according to claim 16, wherein the elastic layer comprises urethane rubber.

19. The toner carrier according to claim 16, wherein at least one layer of the coating layer comprises at least one member selected from the group consisting of fluororesin, polyamide resin, alkyd resin, phenolic resin, melamine resin, silicone resin, polyurethane resin, polyester resin, acrylic resin, acrylic modified silicone resin, styrene-butadiene resin and a mixture of at least two thereof.

20. An image formation apparatus comprising, as a minimum requirement, a toner carrier and an image formation body on the surface of which is formed a visible image by means of a toner supplied from the toner carrier and which is in contact with or in close vicinity to the toner carrier forming a toner thin film on the surface thereof, said image formation apparatus being equipped with the toner carrier as set forth in claim 14.

* * * * *